US007241197B2

(12) United States Patent
De Oliveira

(10) Patent No.: US 7,241,197 B2
(45) Date of Patent: Jul. 10, 2007

(54) STEERING SYSTEM FOR MOVABLE TOY VEHICLES

(76) Inventor: Nenzito C. De Oliveira, 1580 S. Hiawasse Rd., Apt. 190, Orlando, FL (US) 32835-5783

( * ) Notice: Subject to any disclaimer, the term of this patent is extended or adjusted under 35 U.S.C. 154(b) by 0 days.

(21) Appl. No.: 11/242,525

(22) Filed: Oct. 3, 2005

(65) Prior Publication Data

US 2006/0240742 A1 Oct. 26, 2006

Related U.S. Application Data

(60) Provisional application No. 60/674,600, filed on Apr. 25, 2005.

(51) Int. Cl.
*A63H 17/26* (2006.01)
*A63H 17/00* (2006.01)
*A63H 33/02* (2006.01)

(52) U.S. Cl. ..... 446/468; 446/451; 446/465

(58) Field of Classification Search ..... 446/7, 446/431, 449–451, 465, 468, 469, 460; 280/14.28, 280/47.1, 211, 263, 267, 779, 780, 47.11
See application file for complete search history.

(56) References Cited

U.S. PATENT DOCUMENTS

| | | | | | |
|---|---|---|---|---|---|
| 644,718 | A * | 3/1900 | Miller | 280/231 |
| 1,192,081 | A * | 7/1916 | Loxley | 280/267 |
| 1,232,416 | A * | 7/1917 | Whitt | 280/223 |
| 1,318,847 | A * | 10/1919 | Clockers | 280/87.043 |
| 1,369,043 | A * | 2/1921 | Mierzwinski | 280/267 |
| 1,386,346 | A * | 8/1921 | Mack | 280/257 |
| 1,585,832 | A * | 5/1926 | Doud | 280/257 |
| 1,996,546 | A * | 4/1935 | Lindberg | 446/451 |
| 2,147,732 | A | 2/1939 | Boynton | |
| 2,260,679 | A | 10/1941 | Neilson | |
| 2,642,700 | A | 6/1953 | Zimmer | |
| 2,859,975 | A | 11/1958 | Weaver et al. | |
| 3,007,281 | A * | 11/1961 | Pearson et al. | 446/411 |
| 3,018,116 | A | 1/1962 | Summers et al. | |
| 3,669,466 | A * | 6/1972 | Spence | 180/409 |
| 3,762,096 | A * | 10/1973 | Reyes | 446/451 |
| 4,023,434 | A | 5/1977 | Axelsson | |
| 4,030,243 | A * | 6/1977 | Drucker | 446/139 |
| 4,366,645 | A * | 1/1983 | Crain et al. | 446/434 |
| 4,504,074 | A | 3/1985 | Smith | |
| 4,573,941 | A | 3/1986 | Holden et al. | |
| 4,595,380 | A * | 6/1986 | Magers | 446/451 |
| 4,776,604 | A | 10/1988 | Valdez et al. | |
| 5,092,616 | A | 3/1992 | McKinney | |
| 5,240,451 | A * | 8/1993 | Clark, Jr. | 446/465 |
| 5,584,743 | A | 12/1996 | Beaulieu | |
| 6,272,946 | B1 * | 8/2001 | Roux | 74/498 |

* cited by examiner

*Primary Examiner*—Eugene Kim
*Assistant Examiner*—Alyssa M. Hylinski
(74) *Attorney, Agent, or Firm*—John V. Stewart

(57) ABSTRACT

A wheeled vehicle for small children with a steering wheel on a long steering column that extends upward and backward to about waist level of a child walking behind the vehicle. The child propels and steers the vehicle by pushing on the steering wheel and turning the steering wheel. The steering column extends below the vehicle to operate a front steering frame on which are mounted the front wheels. The steering frame is centrally pivotally mounted to the vehicle chassis at the front end of the vehicle. Inexpensive steering transmission and linkage is provided by a flexible cable, cord, or chain wrapped around the lower end of the steering column below the vehicle and spanning to the left and right sides of the steering frame.

11 Claims, 1 Drawing Sheet

PRIOR ART CRAIN

Bottom View

Bottom View

Side view

Side view

PROPOSED CRAIN/MAGERS COMBINATION

Side view

Side view

STEERING SYSTEM FOR MOVABLE TOY VEHICLES

CROSS-REFERENCE TO RELATED APPLICATIONS

Applicant claims the benefit of U.S. provisional patent application 60/674,600, filed Apr. 25, 2005.

BACKGROUND OF THE INVENTION

1. Field of the Invention

This invention relates to steering and propulsion systems for wheeled movable toy vehicles.

2. Description of Prior Art

Inexpensive toy vehicles for young children are made to be pushed and dragged along the floor by hand or at the end of a cord or a stick with no sense of control or direction. Riding toys such as tricycles and pedal-powered vehicles with car bodies are more expensive, bulky, and hazardous for young children than are the types of pre-riding vehicles addressed by this invention. Radio-controlled toy vehicles provide control, but are expensive and too advanced for small children, and are too passive. They provide no exercise, and steering is done with buttons and levers, which is not similar to steering a car, so it does not provide training for steering a car.

Prior U.S patents disclose various mechanisms for steering the front wheels of a toy vehicle. These include U.S. Pat. No. 4,595,380 (Magers), U.S. Pat. No. 5,240,451 (Clark), U.S. Pat. No. 5,584,743 (Beaulieu), and U.S. Pat. No. 6,272,946 (Roux). These mechanisms are sometimes fragile, intricate, and complex, with many interlocking rigid parts. This makes them expensive to manufacture, unreliable, impractical to adjust and maintain. What is needed for commercial success is simplicity, practicality, sturdiness, and low production cost.

SUMMARY OF THE INVENTION

A movable steerable toy vehicle for young children should be inexpensive and safe, but give a sense of control. Ideally, it should interest and occupy the child, improve steering coordination relevant to car driving, and promote exercise. The present invention provides all of these benefits in a wheeled toy vehicle with steering wheel that extends upward and backward from the vehicle on a long steering column to the waist level on a child walking behind the vehicle. The child propels the vehicle by pushing the steering wheel, and steers the vehicle by turning the steering wheel. The child has a view of the vehicle that shows how vehicles respond to steering as in driving and parking a car. The child gets walking exercise during use of the toy vehicle. The steering column has a universal joint, so the angle of the steering column from the vehicle is flexible. This allows the vehicle to turn left or right of the child without dragging. The steering mechanism is especially simple, allowing low cost and high reliability.

REFERENCE CHARACTERS

Figure 1:
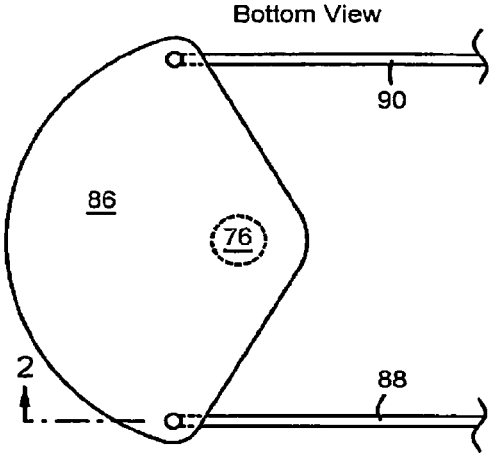
FIG. 1 is a side view of a movable toy vehicle partly in section, with a steering mechanism according to an aspect of the invention.

30. Movable toy vehicle chassis
32. Horizontal chassis bottom member
34. Vertical chassis member
36. Front wheel
38. Steerable front wheel frame
40. Pivot axle of wheel frame
42. Back wheel
50. Steering column
52. Upper end of steering column
54. Steering wheel
56. Locking collar for extension of steering column
58. Lower end of steering column
60. Helical spring as flexible joint in steering column
61. Universal joint
62. Upper retainer flange of steering column
64. Journal plate for steering column
65. Journal wedge for steering column
66. Annular groove in steering column
68. Retainer pin of steering column
70. Steering linkage cable or cord
72. Attachment of end of linkage cord to steering frame
76. Hole in bottom of steering column for cable
78. Setscrew for locking cable in steering column
80. Hole in horizontal chassis element for steering column
82. Protective box
84. Linkage cable port in protective box
86. Hole in bottom of protective box for lower end of steering column
88. Bevel gear on lower end of steering column
90. Bevel gear on bottom of chassis
92. Cylinder on bevel gear on chassis
94. Vertically offset channel through cylinder on bevel gear
96. Setscrew in bottom of cylinder on bevel gear

DETAILED DESCRIPTION

Figure 2:
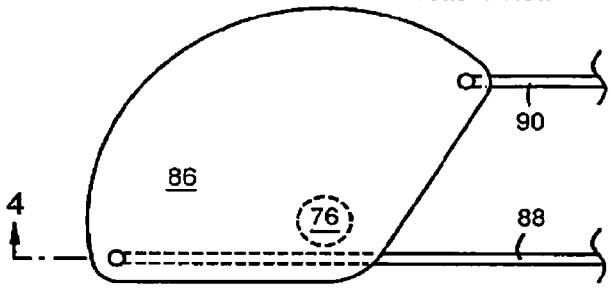
FIG. 2 is a partial bottom view of FIG. 1.

A preferred aspect of the invention is shown in FIGS. 1 and 2, in which a toy vehicle 30 has a chassis with horizontal bottom member 32, a vertical intermediate member 34, and front wheels 36 mounted on a steering frame 38 that pivots on a central vertical axis 40. A steering column 50 has an upper end 52 with a steering wheel 54, and a lower end 58 with a steering linkage 70. The steering column preferably has telescoping sections with locking collars 56 or other known extendable tube locking devices. This feature can be used to adjust the steering wheel height for different sized users and to retract or disassemble the steering column for storage.

The lower end 58 of the steering column passes obliquely through a hole 80 in the bottom member 32 of the chassis, and is journaled in a hole in journal plate 64 that spans diagonally between the bottom member 32 and an intermediate vertical member 34 on the chassis. The journal may have a sealed ring of ball bearings or other known bearing and retaining device. However, a preferred inexpensive journal mechanism comprises a flange 62 fixed to the steering column and resting on the journal plate, and an annular groove 66 just below the journal plate that is retained against the bottom of the journal plate with pins 68.

Figure 5:
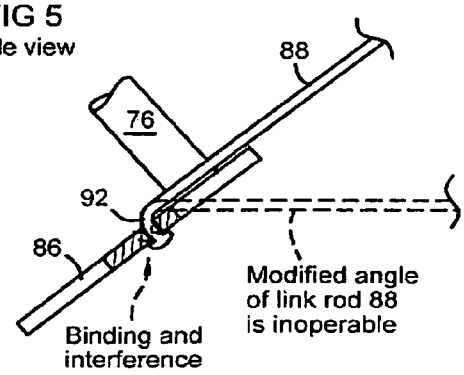
FIG. 5 is a side view of a second aspect of the invention using a pair of bevel gears in the steering linkage.

The holes in the journal plate and the bottom member for the bottom end of the steering column preferably have minimal free-turning clearance around the steering column to hold the steering column steady. The retention mechanism 62, 66, 68 allows it to turn freely. The journal plate may be in the form of a solid wedge 65 as shown in FIG. 5. In this case, the pins 68 pass through lateral holes in the wedge, and a flange 62 is not needed. However, a flange 62 is still recommended in this embodiment. A preferred angle of the steering column is in the range of 30 to 40 degrees from vertical leaning backward.

The steering column preferably has a pivot device such as a universal joint 61 or a helical spring 60 just above the journal. This allows the steering column to pivot in any direction as a child walks behind the toy. The child holds the steering wheel at waist level and propels the toy forward or backward by pushing or pulling against the steering wheel while steering it left and right. A helical spring is a preferred embodiment because it is thought to be less expensive than a universal joint. The upper and lower parts of the steering column may have reduced rounded ends that are inserted tightly a short distance into the respective upper and lower ends of the helical spring. It is suggested that the vehicle chassis may be weighted to avoid tipping from lateral force on the lower end of the steering column when the vehicle is turning.

The two front wheels 36 of the vehicle are attached to a steering frame 38. The steering frame is pivotally mounted 40 at its center to the bottom of the vehicle chassis on a vertical pivot axis. The two front wheels 36 are rotatably attached to the left and right ends of the steering frame. The front bumper of the vehicle can extend below the vehicle and act as a stop for the rotation of the steering frame.

A steering linkage cable or cord 70 links the bottom end of the steering column to the steering frame. This cord has a left span and a right span between the bottom end of the steering column and the respective left and right ends of the steering frame. These two spans may be separate lengths of cord attached to respective left and right sides of the bottom end of the steering column. Alternately, as shown in FIGS. 1 and 2, the two spans may be the left and right halves of a continuous cord that is fixed at its midpoint through a hole 76 in the column 68 by means of a setscrew 78. The cord exits the hole 76 on two opposite sides of the column, and from each exit it wraps around the back of the column, then spans to the nearest end of the steering frame. It is attached to the steering frame using a screw, hook, or a wedging groove on the steering frame. This linkage causes the steering frame to turn in the same direction as the steering wheel.

A protective box 82 may be provided over the lower end of the steering column below the vehicle chassis. It has ports 84 for the linkage cable 70. It may have a hole 86 in the bottom for the lower end of the steering column. This box protects the linkage mechanism, and prevents the cord from slipping off the lower end of the steering column. With such a box, the steering column can be angled up to about 40 degrees backward from vertical. Without a box, the preferable steering column angle is about 30 degrees backward from vertical. The box can be screwed to the bottom of the chassis, so it can be easily removed for linkage repair or adjustment.

Figure 6:
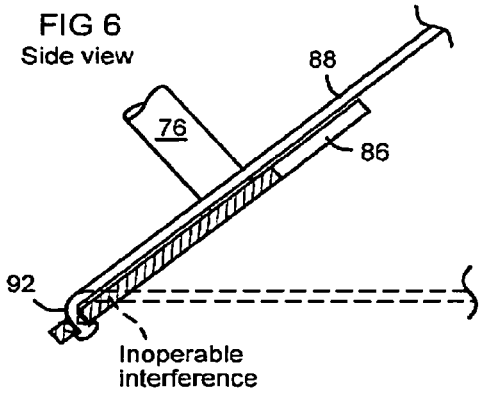
FIG. 6 is a partial bottom view of FIG. 5.
Figure 1:
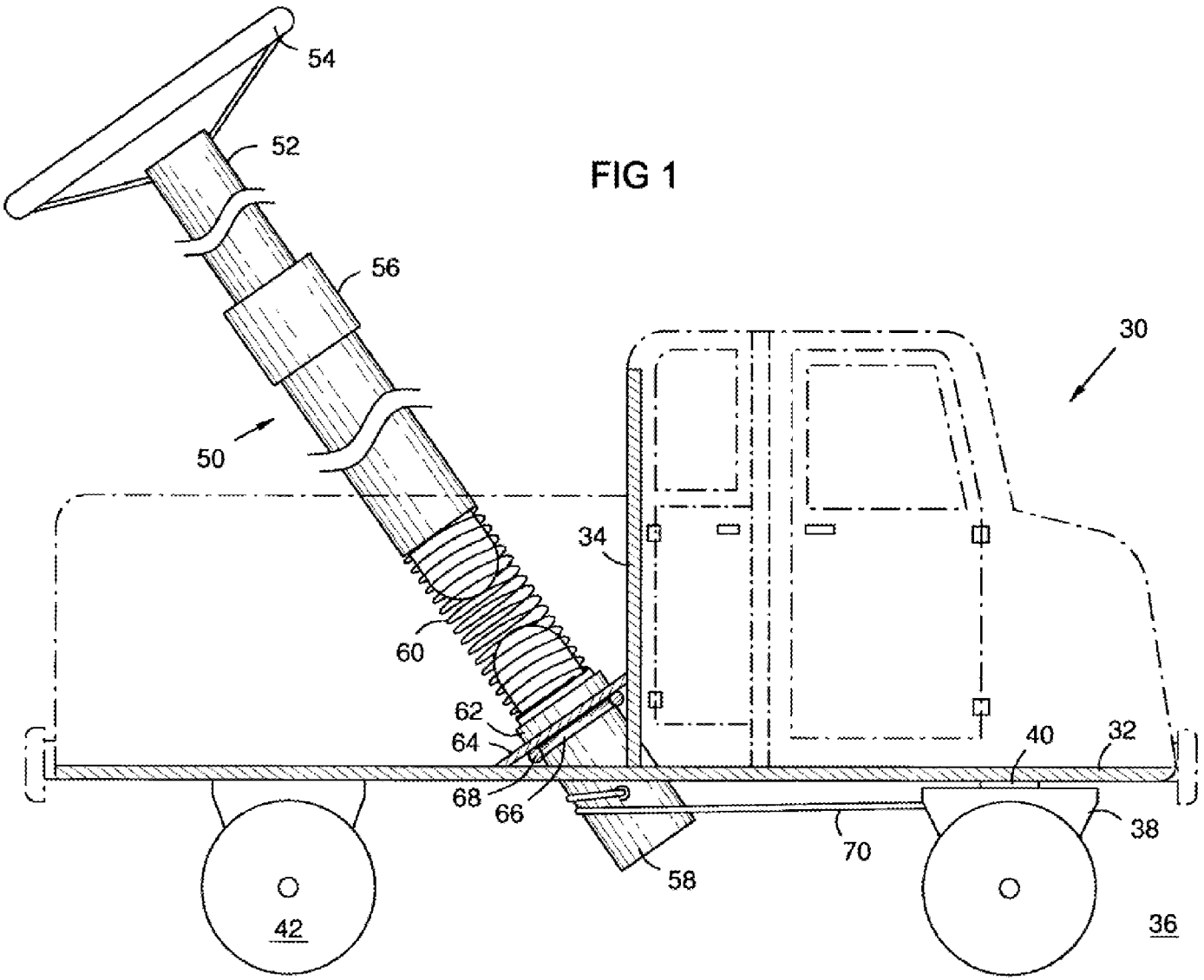
Figure 2:
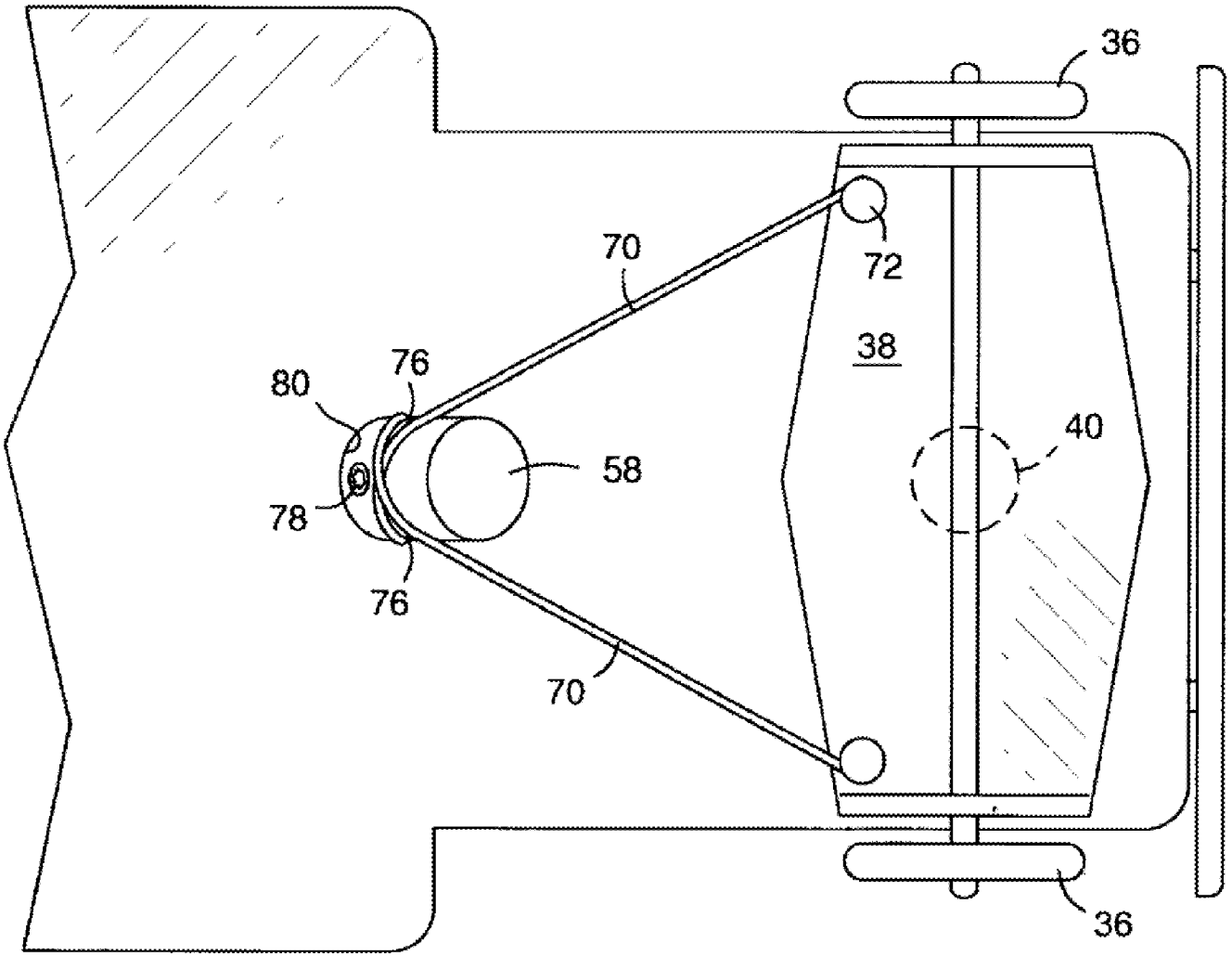
Figure 1:
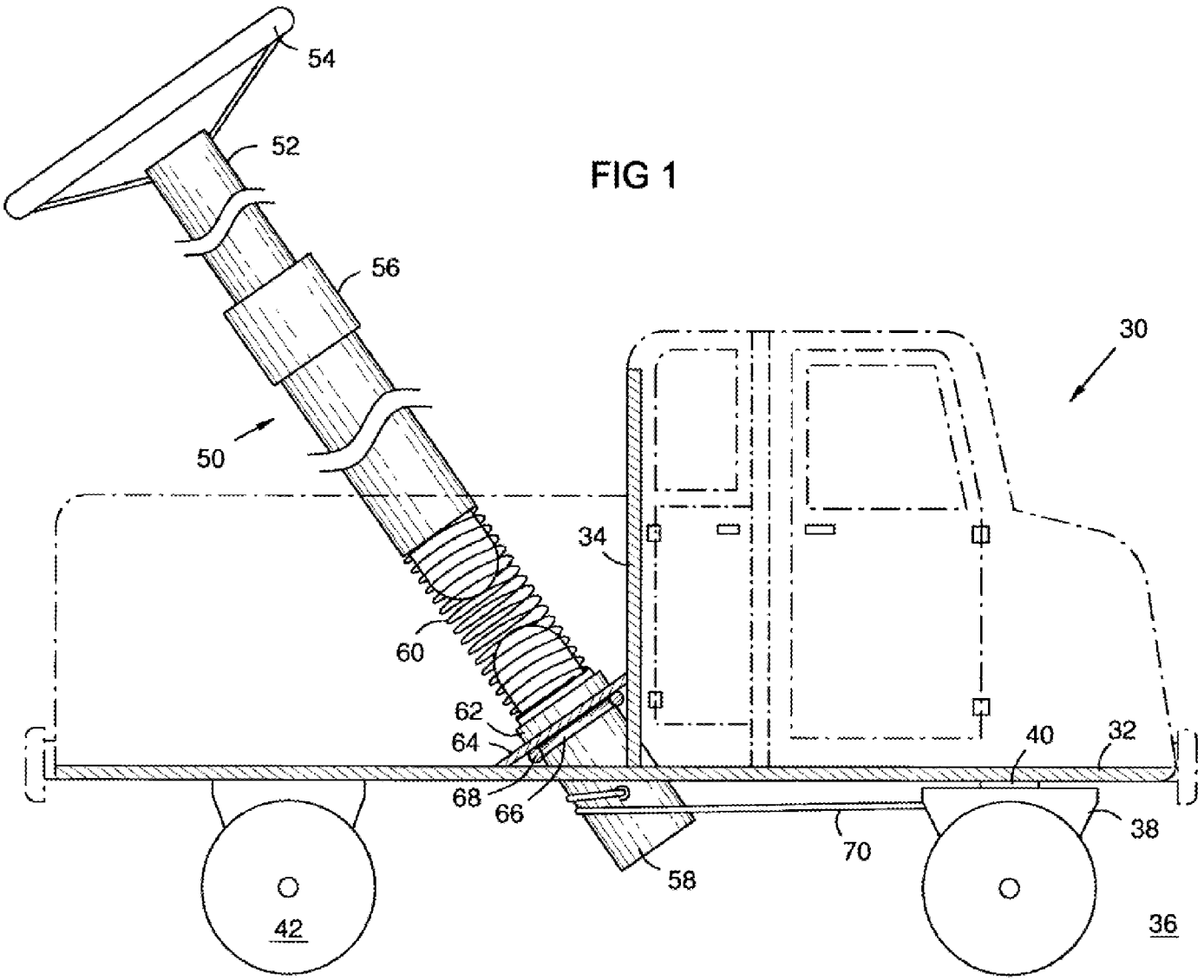
Figure 2:
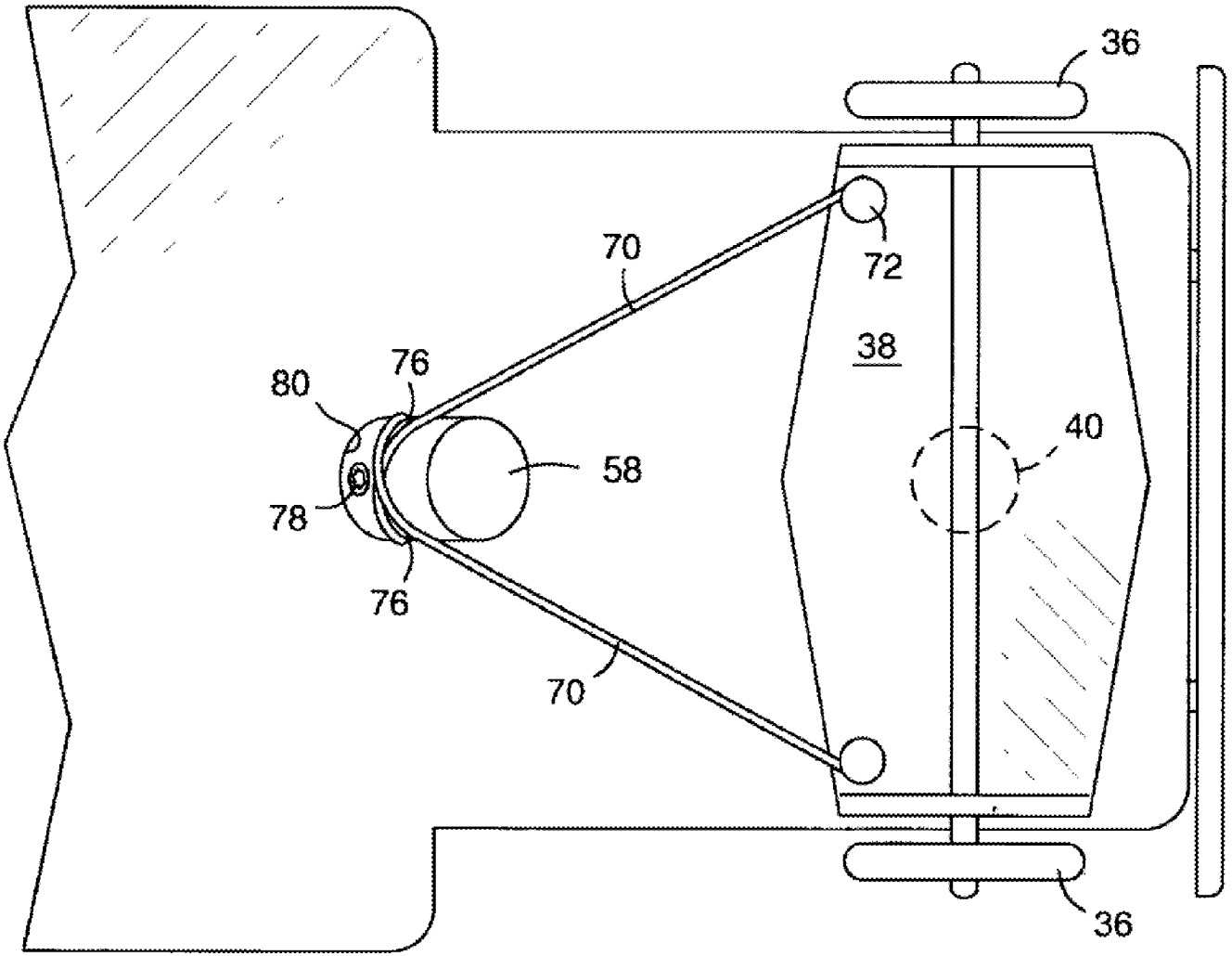

FIGS. 5 and 6 show a second aspect of the invention using a first bevel gear 88 on the lower end of the steering linkage, a second bevel gear 90 on the bottom of the chassis, and a cylinder 92 on the second bevel gear. The linkage cord 70 is attached to the cylinder and crosses in front of it as shown. This crossing of the cord causes the steering frame to turn in the same direction as the steering wheel despite the reversed direction of the second bevel gear. In order to avoid rubbing of the cord against itself at the crossing point the left and right spans of the cord are vertically offset on the cylinder. This can be accomplished by means of a vertically offset channel 94 through the cylinder as shown. One end of this channel is higher than the other, so the left and right spans of the linkage cord cross each other without touching each other. A setscrew 96 in the bottom of the cylinder may be used to lock the middle of the cord in the channel. With this bevel gear mechanism, the steering column can be angled up to about 55 degrees backward from vertical. Optionally, the linkage cord can wrap around the back side of the cylinder before crossing in front, allowing a larger maximum turning angle of the steering frame.

Although the present invention has been described herein with respect to preferred embodiments, it will be understood that the foregoing description is intended to be illustrative, not restrictive. Modifications of the present invention will occur to those skilled in the art. All such modifications that fall within the scope of the appended claims are intended to be within the scope and spirit of the present invention.

I claim:

1. A movable wheeled vehicle comprising:

a vehicle chassis comprising front and back ends, an intermediate vertical member, and a bottom with a horizontal chassis member;

a front steering frame comprising left and right ends and a central pivot attachment with a vertical axis attached to the bottom of the chassis;

left and right front wheels rotatably attached to the respective left and right ends of the steering frame;

a steering column comprising a cylindrical lower portion with a cylindrical lower end extending coaxially therewith obliquely backward from below the bottom of the chassis and having a back side, an upper portion extending upward and backward obliquely from the chassis, and an upper end with a steering wheel;

the lower portion of the steering column rotatably mounted to the chassis by a journal with an axis;

a steering linkage comprising a substantially horizontal flexible left span attached to the left end of the steering frame, a substantially horizontal flexible right span attached to the right end of the steering frame, and a transmission mechanism for converting rotary motion of the lower end of the steering column to complementary linear motions in the flexible spans that turn the steering frame in the same direction as the steering column; and a flexible joint in the steering column above the journal that allows the upper portion of the steering column to pivot in all directions away from the journal axis;

wherein the left span spans directly between the left end of the steering frame and the lower end of the steering column; and the right span spans directly between the right end of the steering frame and the lower end of the steering column.

2. The movable wheeled vehicle of claim 1, wherein the journal comprises:

a journal wedge generally filling a space between the horizontal chassis member and the vertical chassis member, the lower portion of the steering column passing through a hole in the journal wedge; and a retainer on the lower portion of the steering column within the journal wedge comprising an annular groove on the lower portion of the steering column, and at least one pin passing through the wedge and through the groove that prevents motion of the lower portion of the steering column along the journal axis, but allows rotation of the lower portion of the steering column about the journal axis.

3. The movable wheeled vehicle of claim 1, further comprising a linkage protection box attached to the bottom of the chassis having two ports for the flexible spans and a bottom plate with a central hole for passage of the lower end of the steering column, wherein the bottom plate blocks the flexible spans from slipping off the lower end of the steering column.

4. The movable wheeled vehicle of claim 1, wherein the flexible joint in the steering column comprises a helical spring.

5. A movable wheeled vehicle comprising:

a vehicle chassis comprising front and back ends, an intermediate vertical member, and a bottom with a horizontal chassis member;

a front steering frame comprising left and right ends and a central pivot attachment with a vertical axis attached to the bottom front end of the chassis;

left and right front wheels rotatably attached to the respective left and right ends of the steering frame, the central pivot attachment substantially centered between the left and right front wheels;

a steering column comprising a lower cylindrical portion with a lower end extending coaxially with the steering column obliquely below the bottom of the chassis and having a back side, an upper portion extending upward and backward obliquely from the chassis, and an upper end with a steering wheel;

a journal plate diagonally attached between the horizontal chassis member and the vertical chassis member, having an upper surface at a given angle between 30 and 40 degrees backward from horizontal, and the lower cylindrical portion of the steering column passes through and rotates within a hole in the journal plate with a journal axis normal to the upper surface of the journal plate;

a flange on the lower cylindrical portion of the steering column that rests on the upper surface of the journal plate and slidably rotates thereon;

a retainer on the lower cylindrical portion of the steering column below the upper surface of the journal plate that prevents motion of the lower cylindrical portion of the steering column along the journal axis, but allows rotation of the lower cylindrical portion of the steering column about the journal axis;

a steering linkage comprising a substantially horizontal flexible left span and a substantially horizontal flexible right span, each span connected directly between the lower cylindrical portion of the steering column and the respective left and right ends of the steering frame to transmit rotary motion in the steering column to rotary motion in the same direction in the steering frame;

a flexible joint in the steering column above the journal that allows the upper portion of the steering column to pivot in all directions away from the journal axis; and a linkage protection box attached to the bottom of the chassis having two ports for the flexible spans and a bottom plate with a central hole for passage of the lower end of the steering column, wherein the bottom plate blocks the flexible spans from slipping off the lower end of the steering column.

6. The movable wheeled vehicle of claim 5 wherein the flexible joint comprises a helical spring.

7. A movable wheeled vehicle comprising:

a vehicle chassis comprising front and back ends, an intermediate vertical member, and a bottom with a horizontal chassis member;

a front steering frame comprising left and right ends and a central pivot attachment with a vertical axis attached to the bottom of the chassis;

left and right front wheels rotatably attached to the respective left and right ends of the steering frame;

a steering column comprising a lower portion with a lower end extending coaxially therewith obliquely backward from below the bottom of the chassis and having a back side, an upper portion extending upward and backward obliquely from the chassis, and an upper end with a steering wheel;

the lower portion of the steering column rotatably mounted to the chassis by a journal with an axis;

a steering linkage comprising a substantially horizontal flexible left span attached to the left end of the steering frame, a substantially horizontal flexible right span attached to the right end of the steering frame, and a transmission mechanism for converting rotary motion of the lower end of the steering column to complementary linear motions in the flexible spans that turn the steering frame in the same direction as the steering column; and a flexible joint in the steering column above the journal that allows the upper portion of the steering column to pivot in all directions away from the journal axis;

wherein the lower portion of the steering column is cylindrical, the left and right spans are attached to the lower portion of the steering column, wrapped around the back side of the lower portion of the steering column, and span directly between the lower portion of the steering column and the respective left or right end of the steering frame, the left and right spans formed by a cable that passes through a hole in the lower portion of the steering column and is fixed in the hole with a screw.

8. The movable wheeled vehicle of claim 7, wherein the journal comprises:

a journal plate mounted between the horizontal chassis member and the vertical chassis member, having an upper surface at a given angle between 30 and 40 degrees from horizontal, the lower portion of the steering column passing through and rotating within a hole in the journal plate substantially normal to the upper surface thereof;

a flange on the lower portion of the steering column that rests on the upper surface of the journal plate and rotates slidably thereon; and a retainer on the lower portion of the steering column below the upper surface of the journal plate that prevents motion of the lower portion of the steering column along the journal axis, but allows rotation of the lower portion of the steering column about the journal axis within the hole in the journal plate.

9. The movable wheeled vehicle of claim 8, wherein the journal plate has a bottom surface, and the retainer comprises:

an annular groove around the lower portion of the steering column having, a minor circumference; and at least one pin passing along the bottom surface of the journal plate tangent to the minor circumference of the annular groove.

10. The movable wheeled vehicle of claim 1 wherein the left and right spans are formed by a cable that passes through a hole in the lower portion of the steering column and is fixed in the hole with a screw.

11. The movable wheeled vehicle of claim 5 wherein the left and right spans are formed by a cable that passes through a hole in the lower portion of the steering column and is fixed in the hole with a screw.

* * * * *

UNITED STATES PATENT AND TRADEMARK OFFICE

CERTIFICATE OF CORRECTION

PATENT NO. : 7,241,197 B2
APPLICATION NO. : 11/242525
DATED : July 10, 2007
INVENTOR(S) : De Oliveria It is certified that error appears in the above-identified patent and that said Letters Patent is hereby corrected as shown below:

THE TITLE PAGE SHOWING AN ILLUSTRATIVE FIGURE, SHOULD BE DELETED AND SUBSTITUTE THEREFOR THE ATTACHED TITLE PAGE.

ON THE TITLE PAGE ITEM (76) SHOULD READ

--Nenzito C. De Oliveria
3201 Turtle Creek Rd.
St. Augustine FL 32086-5939--

DELETE DRAWINGS SHEET 1 AND SUBSTITUTE THEREFOR THE DRAWINGS SHEETS CONSISTING OF FIGS 1-6 AS SHOWN ON THE ATTACHED PAGES.

Signed and Sealed this

First Day of April, 2008

JON W. DUDAS
*Director of the United States Patent and Trademark Office*

(12) United States Patent
De Oliveira

(10) Patent No.: US 7,241,197 B2
(45) Date of Patent: Jul. 10, 2007

(54) STEERING SYSTEM FOR MOVABLE TOY VEHICLES

(76) Inventor: Nenzito C. De Oliveira, 1580 S. Hiawasse Rd., Apt. 190, Orlando, FL (US) 32835-5783

( * ) Notice: Subject to any disclaimer, the term of this patent is extended or adjusted under 35 U.S.C. 154(b) by 0 days.

(21) Appl. No.: 11/242,525

(22) Filed: Oct. 3, 2005

(65) Prior Publication Data

US 2006/0240742 A1 Oct. 26, 2006

Related U.S. Application Data

(60) Provisional application No. 60/674,600, filed on Apr. 25, 2005.

(51) Int. Cl.
*A63H 17/26* (2006.01)
*A63H 17/00* (2006.01)
*A63H 33/02* (2006.01)

(52) U.S. Cl. ..... 446/468; 446/451; 446/465

(58) Field of Classification Search ..... 446/7, 446/431, 449–451, 465, 468, 469, 460; 280/14.28, 280/47.1, 211, 263, 267, 779, 780, 47.11
See application file for complete search history.

(56) References Cited

U.S. PATENT DOCUMENTS

| | | | | | |
|---|---|---|---|---|---|
| 644,718 | A | * | 3/1900 | Miller | 280/231 |
| 1,192,081 | A | * | 7/1916 | Loxley | 280/267 |
| 1,232,416 | A | * | 7/1917 | Whitt | 280/223 |
| 1,318,847 | A | * | 10/1919 | Clockers | 280/87.043 |
| 1,369,043 | A | * | 2/1921 | Mierzwinski | 280/267 |
| 1,386,346 | A | * | 8/1921 | Mack | 280/257 |
| 1,585,832 | A | * | 5/1926 | Doud | 280/257 |
| 1,996,546 | A | * | 4/1935 | Lindberg | 446/451 |
| 2,147,732 | A | | 2/1939 | Boynton | |
| 2,260,679 | A | | 10/1941 | Neilson | |
| 2,642,700 | A | | 6/1953 | Zimmer | |
| 2,859,975 | A | | 11/1958 | Weaver et al. | |
| 3,007,281 | A | * | 11/1961 | Pearson et al. | 446/411 |
| 3,018,116 | A | | 1/1962 | Summers et al. | |
| 3,669,466 | A | * | 6/1972 | Spence | 180/409 |
| 3,762,096 | A | * | 10/1973 | Reyes | 446/451 |
| 4,023,434 | A | | 5/1977 | Axelsson | |
| 4,030,243 | A | * | 6/1977 | Drucker | 446/139 |
| 4,366,645 | A | * | 1/1983 | Crain et al. | 446/434 |
| 4,504,074 | A | | 3/1985 | Smith | |
| 4,573,941 | A | | 3/1986 | Holden et al. | |
| 4,595,380 | A | * | 6/1986 | Magers | 446/451 |
| 4,776,604 | A | | 10/1988 | Valdez et al. | |
| 5,092,616 | A | | 3/1992 | McKinney | |
| 5,240,451 | A | * | 8/1993 | Clark, Jr. | 446/465 |
| 5,584,743 | A | | 12/1996 | Beaulieu | |
| 6,272,946 | B1 | * | 8/2001 | Roux | 74/498 |

* cited by examiner

*Primary Examiner*—Eugene Kim
*Assistant Examiner*—Alyssa M. Hylinski
(74) *Attorney, Agent, or Firm*—John V. Stewart

(57) ABSTRACT

A wheeled vehicle for small children with a steering wheel on a long steering column that extends upward and backward to about waist level of a child walking behind the vehicle. The child propels and steers the vehicle by pushing on the steering wheel and turning the steering wheel. The steering column extends below the vehicle to operate a front steering frame on which are mounted the front wheels. The steering frame is centrally pivotally mounted to the vehicle chassis at the front end of the vehicle. Inexpensive steering transmission and linkage is provided by a flexible cable, cord, or chain wrapped around the lower end of the steering column below the vehicle and spanning to the left and right sides of the steering frame.

11 Claims, 1 Drawing Sheet

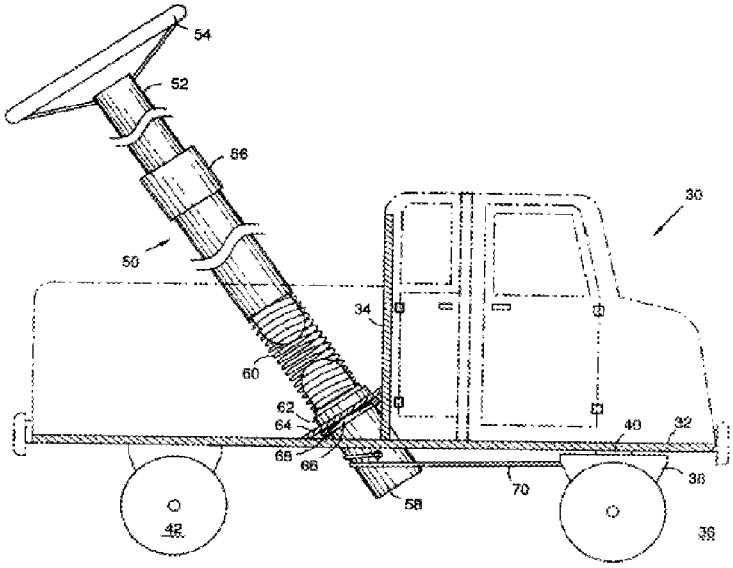

Figure 3:
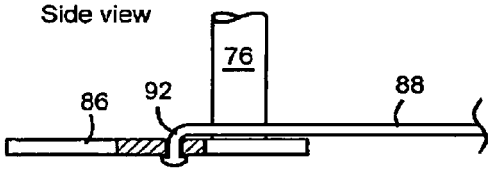
FIG. 3 is a partial side view as in FIG. 1 with an added linkage protection box.
Figure 4:
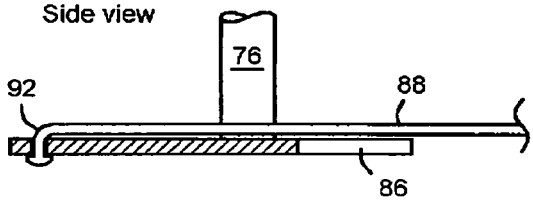
FIG. 4 is a partial bottom view as in FIG. 2 with an added linkage protection box.

FIG 3
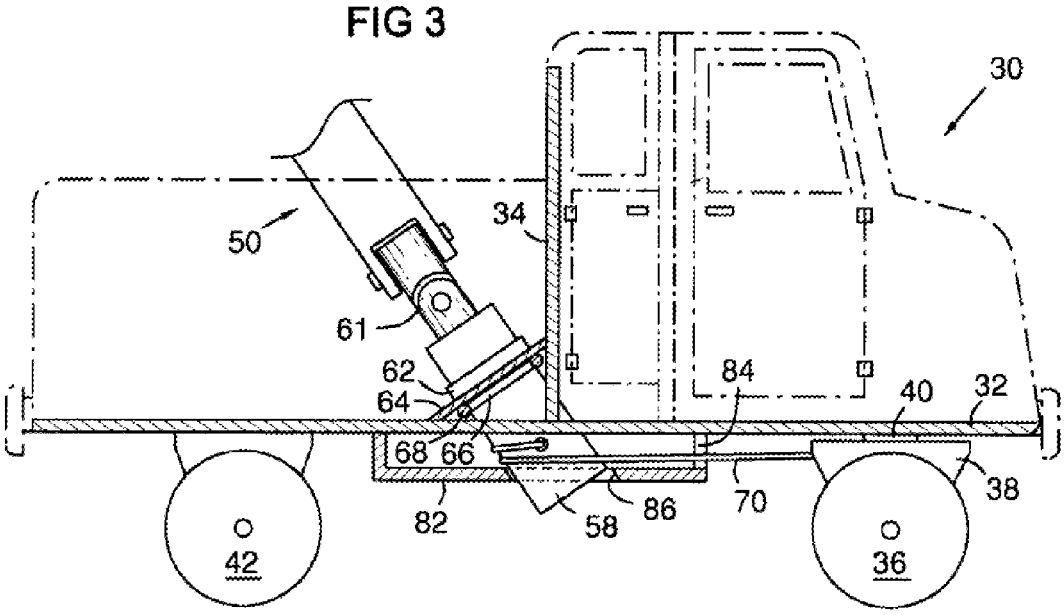
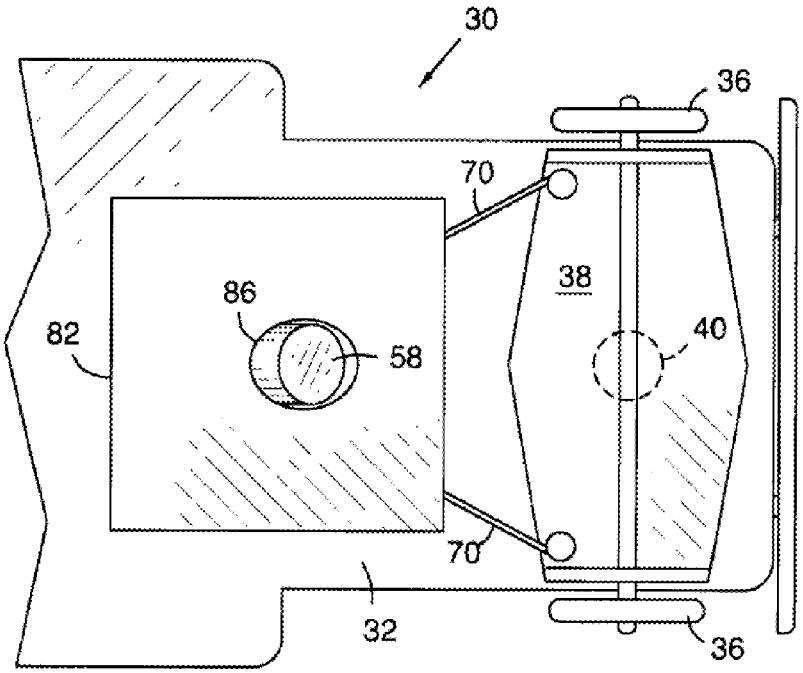
FIG 4

FIG 5
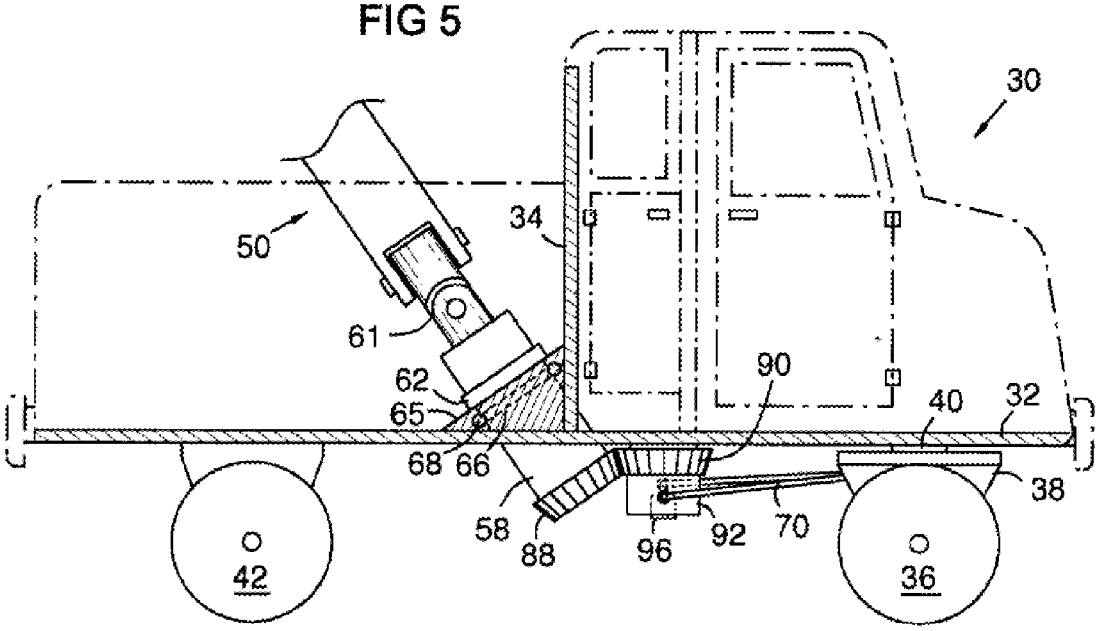
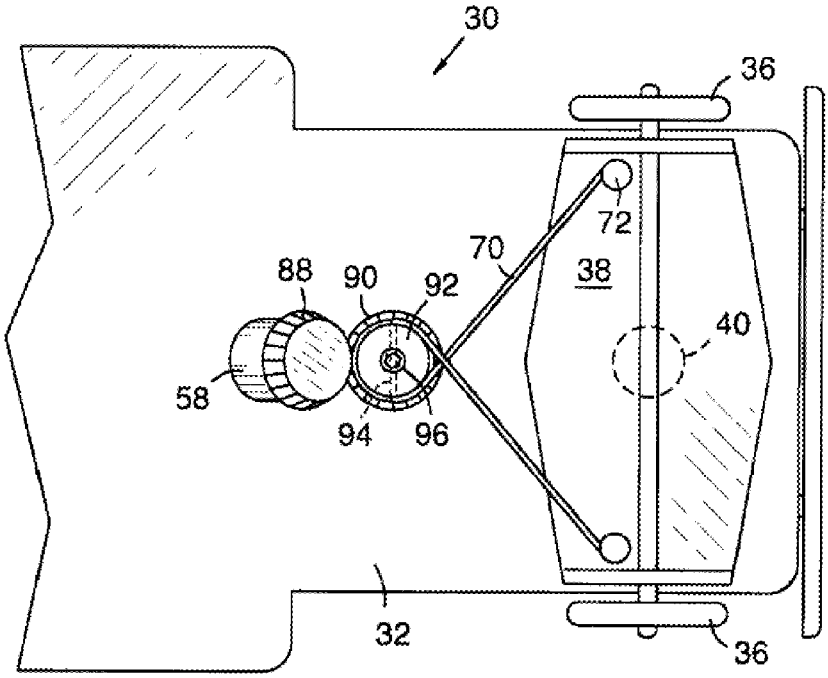
FIG 6

UNITED STATES PATENT AND TRADEMARK OFFICE

CERTIFICATE OF CORRECTION

PATENT NO. : 7,241,197 B2
APPLICATION NO. : 11/242525
DATED : July 10, 2007
INVENTOR(S) : De Oliveira It is certified that error appears in the above-identified patent and that said Letters Patent is hereby corrected as shown below:

THE TITLE PAGE SHOWING AN ILLUSTRATIVE FIGURE, SHOULD BE DELETED AND SUBSTITUTE THEREFOR THE ATTACHED TITLE PAGE.

ON THE TITLE PAGE ITEM (76) SHOULD READ

--Nenzito C. De Oliveira
3201 Turtle Creek Rd.
St. Augustine FL 32086-5939--

DELETE DRAWINGS SHEET 1 AND SUBSTITUTE THEREFOR THE DRAWINGS SHEETS CONSISTING OF FIGS 1-6 AS SHOWN ON THE ATTACHED PAGES.

This certificate supersedes the Certificate of Correction issued April 1, 2008.

Signed and Sealed this

Sixth Day of May, 2008

JON W. DUDAS
*Director of the United States Patent and Trademark Office*

(12) United States Patent
De Oliveira

(10) Patent No.: US 7,241,197 B2
(45) Date of Patent: Jul. 10, 2007

(54) STEERING SYSTEM FOR MOVABLE TOY VEHICLES

(76) Inventor: Nenzito C. De Oliveira, 3201 Turtle Creek Rd., St. Augustine, FL (US) 32086-5939

( * ) Notice: Subject to any disclaimer, the term of this patent is extended or adjusted under 35 U.S.C. 154(b) by 0 days.

(21) Appl. No.: 11/242,525

(22) Filed: Oct. 3, 2005

(65) Prior Publication Data

US 2006/0240742 A1 Oct. 26, 2006

Related U.S. Application Data

(60) Provisional application No. 60/674,600, filed on Apr. 25, 2005.

(51) Int. Cl.
*A63H 17/26* (2006.01)
*A63H 17/00* (2006.01)
*A63H 33/02* (2006.01)

(52) U.S. Cl. ..... 446/468; 446/451; 446/465

(58) Field of Classification Search ..... 446/7, 446/431, 449–451, 465, 468, 469, 460; 280/14.28, 280/47.1, 211, 263, 267, 779, 780, 47.11
See application file for complete search history.

(56) References Cited

U.S. PATENT DOCUMENTS

| | | | | |
|---|---|---|---|---|
| 644,718 A | * | 3/1900 | Miller | 280/231 |
| 1,192,081 A | * | 7/1916 | Loxley | 280/267 |
| 1,232,416 A | * | 7/1917 | Whitt | 280/223 |
| 1,318,847 A | * | 10/1919 | Clockers | 280/87.043 |
| 1,369,043 A | * | 2/1921 | Mierzwoski | 280/267 |
| 1,386,346 A | * | 8/1921 | Mack | 280/257 |
| 1,585,832 A | * | 5/1926 | Doud | 280/257 |
| 1,996,546 A | * | 4/1935 | Lindberg | 446/451 |
| 2,147,732 A | | 2/1939 | Boynton | |
| 2,260,679 A | | 10/1941 | Neilson | |
| 2,642,700 A | | 6/1953 | Zimmer | |
| 2,859,975 A | | 11/1958 | Weaver et al. | |
| 3,007,281 A | * | 11/1961 | Pearson et al. | 446/411 |
| 3,018,116 A | | 1/1962 | Summers et al. | |
| 3,669,466 A | * | 6/1972 | Spence | 180/409 |
| 3,762,096 A | * | 10/1973 | Reyes | 446/451 |
| 4,023,434 A | | 5/1977 | Axelsson | |
| 4,030,243 A | * | 6/1977 | Drucker | 446/139 |
| 4,366,645 A | * | 1/1983 | Crain et al. | 446/434 |
| 4,504,074 A | | 3/1985 | Smith | |
| 4,573,941 A | | 3/1986 | Holden et al. | |
| 4,595,380 A | * | 6/1986 | Magers | 446/451 |
| 4,776,604 A | | 10/1988 | Valdez et al. | |
| 5,092,616 A | | 3/1992 | McKinney | |
| 5,240,451 A | * | 8/1993 | Clark, Jr. | 446/465 |
| 5,584,743 A | | 12/1996 | Beaulieu | |
| 6,272,946 B1 | * | 8/2001 | Roux | 74/498 |

* cited by examiner

*Primary Examiner*—Eugene Kim
*Assistant Examiner*—Alyssa M. Hylinski
(74) *Attorney, Agent, or Firm*—John V. Stewart

(57) ABSTRACT

A wheeled vehicle for small children with a steering wheel on a long steering column that extends upward and backward to about waist level of a child walking behind the vehicle. The child propels and steers the vehicle by pushing on the steering wheel and turning the steering wheel. The steering column extends below the vehicle to operate a front steering frame on which are mounted the front wheels. The steering frame is centrally pivotally mounted to the vehicle chassis at the front end of the vehicle. Inexpensive steering transmission and linkage is provided by a flexible cable, cord, or chain wrapped around the lower end of the steering column below the vehicle and spanning to the left and right sides of the steering frame.

11 Claims, 4 Drawing Sheets

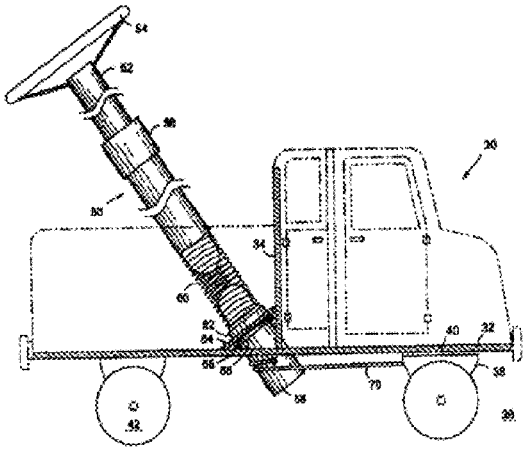

FIG 3
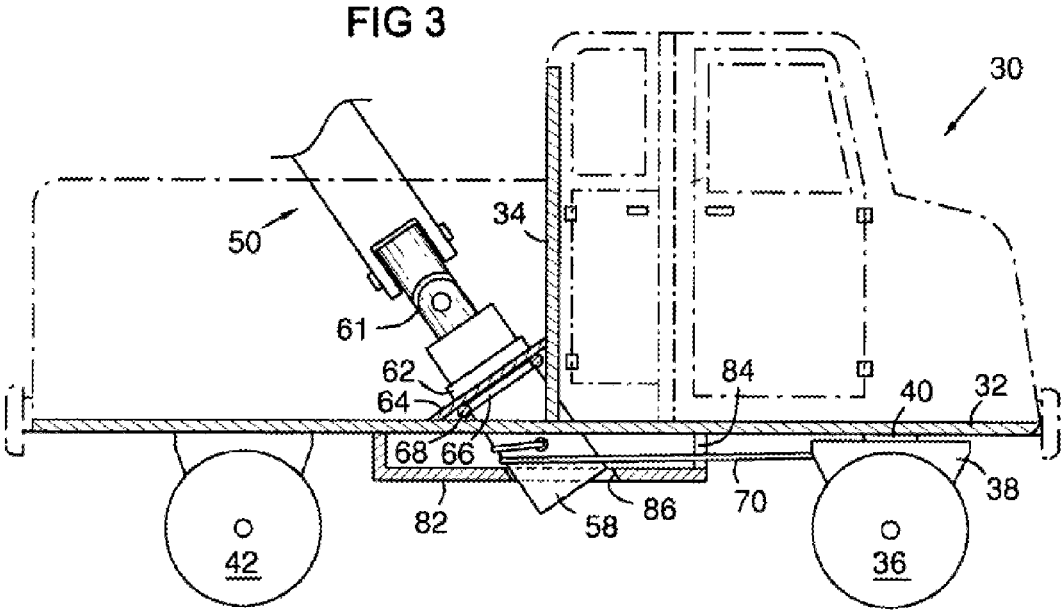
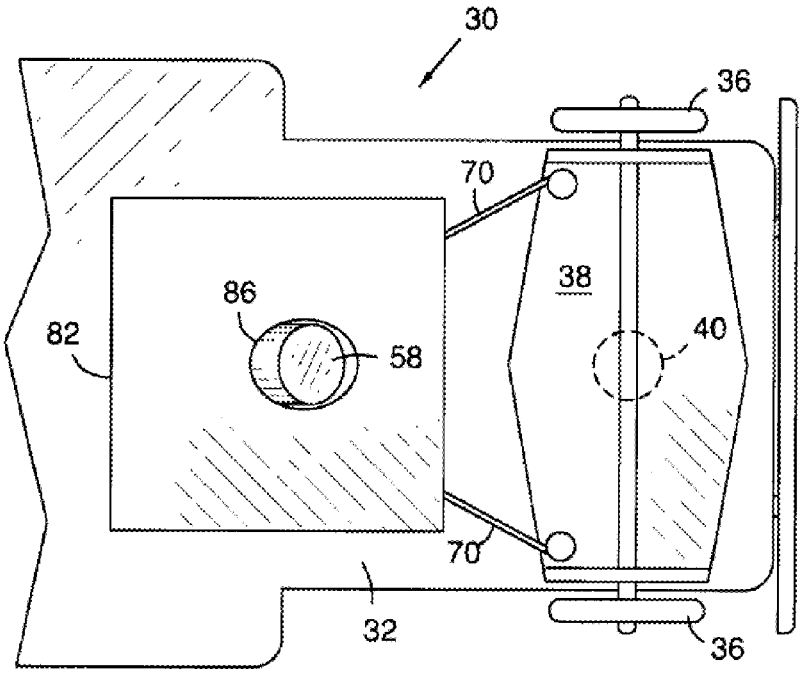
FIG 4

FIG 5
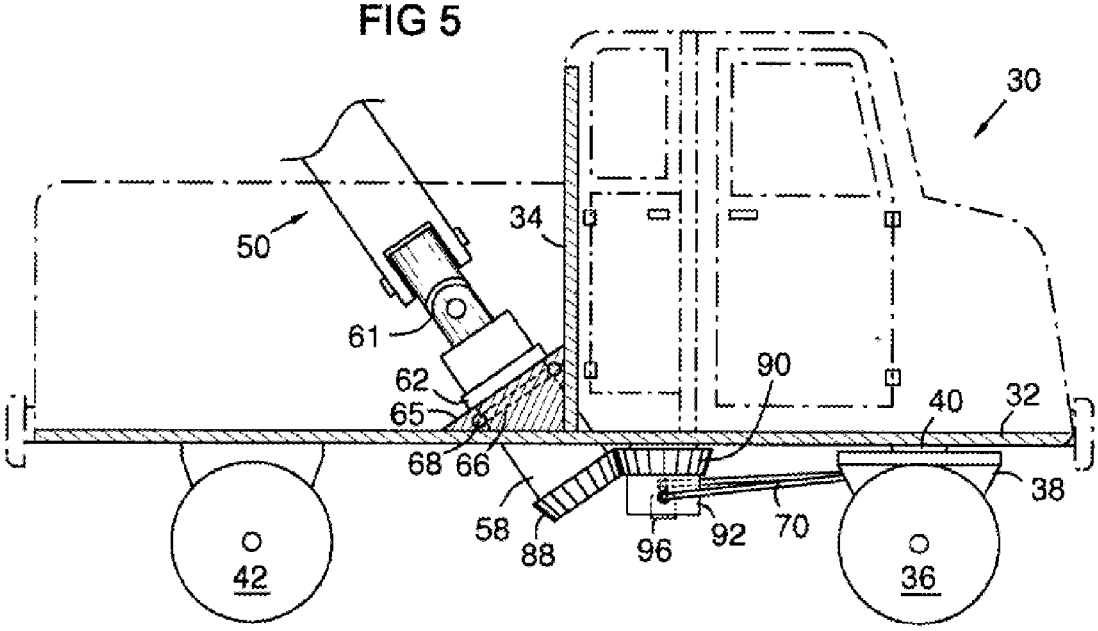
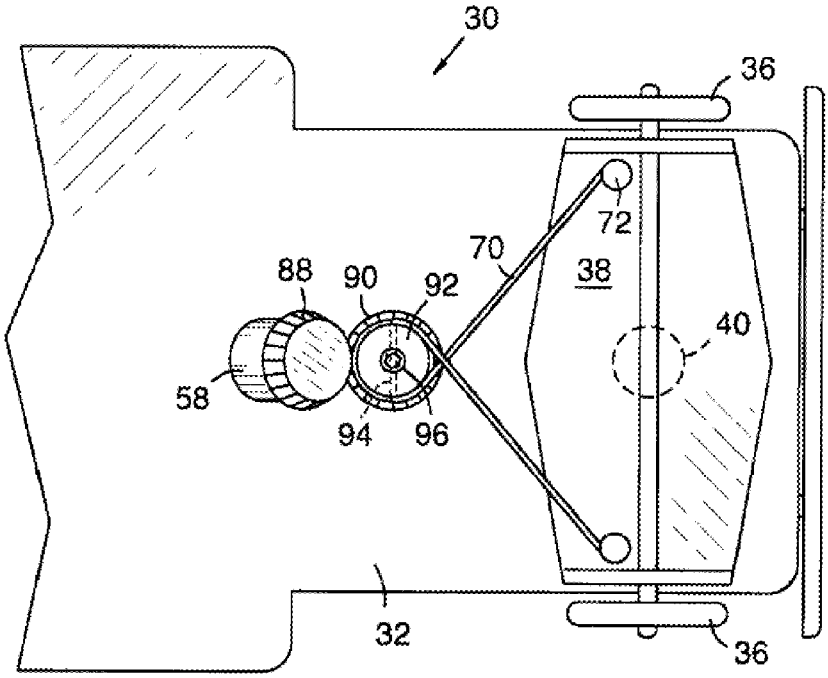
FIG 6